US009220387B2

(12) United States Patent
Nonnenmann et al.

(10) Patent No.: US 9,220,387 B2
(45) Date of Patent: Dec. 29, 2015

(54) SWEEPING MACHINE

(71) Applicant: Alfred Kärcher GmbH & Co. KG, Winnenden (DE)

(72) Inventors: Frank Nonnenmann, Schordorf (DE); Erik Hoernlen, Remseck am Neckar (DE); Florian Abt, Stuttgart (DE)

(73) Assignee: Alfred Kärcher GmbH & Co. KG, Winnenden (DE)

( * ) Notice: Subject to any disclaimer, the term of this patent is extended or adjusted under 35 U.S.C. 154(b) by 0 days.

(21) Appl. No.: 14/154,914

(22) Filed: Jan. 14, 2014

(65) Prior Publication Data

US 2014/0123433 A1 May 8, 2014

Related U.S. Application Data

(63) Continuation of application No. PCT/EP2011/062620, filed on Jul. 22, 2011.

(51) Int. Cl.

| | |
|---|---|
| ***A47L 11/24*** | (2006.01) |
| ***A47L 11/40*** | (2006.01) |
| ***A47L 9/20*** | (2006.01) |
| ***A47L 9/10*** | (2006.01) |

(52) U.S. Cl.

CPC . *A47L 9/102* (2013.01); *A47L 9/20* (2013.01); *A47L 11/24* (2013.01); *A47L 11/4033* (2013.01)

(58) Field of Classification Search

CPC ..... A47L 11/24; A47L 11/4033; A47L 9/20; A47L 9/102

USPC ..... 15/349, 340.3, 348

See application file for complete search history.

(56) References Cited

U.S. PATENT DOCUMENTS

| | | |
|---|---|---|
| 3,798,878 A | 3/1974 | Pausch |
| 3,973,935 A | 8/1976 | Moore, Jr. et al. |

(Continued)

FOREIGN PATENT DOCUMENTS

| | | |
|---|---|---|
| DE | 41 38 223 | 2/1993 |
| DE | 10 2005 036 807 | 2/2007 |

(Continued)

*Primary Examiner* — Dung Van Nguyen

(74) *Attorney, Agent, or Firm* — Womble Carlyle Sandridge & Rice, LLP

(57) ABSTRACT

A sweeping machine includes a sweeping brush capable of being driven in rotation, a debris container, a suction fan and at least one filter arranged in the flow path between the sweeping brush and the suction fan, in flow communication with the suction fan via a suction conduit, in flow communication with a pressure vessel via an external air conduit and at least one external air valve and, for filter cleaning, is capable of having external air stored in the pressure vessel applied thereto. In order for the filter to be capable of being cleaned effectively with as little external air as possible and with the external air being at as low a positive pressure as possible, the external air conduit includes a hood which covers the filter on a clean side thereof and forms a first section of the suction conduit which adjoins the clean side of the filter.

16 Claims, 3 Drawing Sheets

(56) References Cited

U.S. PATENT DOCUMENTS

| | | | | |
|---|---|---|---|---|
| 4,007,026 | A | 2/1977 | Groh | |
| 4,099,940 | A | 7/1978 | Mortensen et al. | |
| 4,452,616 | A | 6/1984 | Gillingham et al. | |
| 4,486,201 | A | 12/1984 | Noguchi | |
| 4,514,875 | A | 5/1985 | Comer | |
| 4,637,825 | A | 1/1987 | Howeth | |
| 4,756,727 | A | 7/1988 | Howeth | |
| 5,013,333 | A * | 5/1991 | Beaufoy et al. | 95/20 |
| 5,901,407 | A | 5/1999 | Boomgaarden | |
| 6,117,200 | A * | 9/2000 | Berg et al. | 55/287 |
| 8,505,161 | B2 | 8/2013 | Schick et al. | |
| 2009/0193612 | A1 * | 8/2009 | Weiss et al. | 15/347 |
| 2013/0025076 | A1 * | 1/2013 | Schick et al. | 15/21.1 |

FOREIGN PATENT DOCUMENTS

| | | |
|---|---|---|
| EP | 0 955 003 | 11/1999 |
| EP | 1 166 705 | 1/2002 |
| WO | WO 97/00115 | 1/1997 |
| WO | WO 2009/132757 | 11/1999 |

* cited by examiner

SWEEPING MACHINE

CROSS-REFERENCE TO RELATED APPLICATIONS

This application is a continuation of international application number PCT/EP2011/062620, filed on Jul. 22, 2011, which is incorporated herein by reference in its entirety and for all purposes.

BACKGROUND OF THE INVENTION

The invention relates to a sweeping machine comprising a sweeping brush that is capable of being driven in rotation, a debris container and a suction fan for suctioning dust-laden air, and at least one filter arranged in the flow path between the sweeping brush and the suction fan, for separating particles of dust and dirt from the suctioned air, wherein the filter is in flow communication with the suction fan by way of a suction conduit and is in flow communication with a pressure vessel by way of an external air conduit and at least one external air valve and, for filter cleaning, is capable of having applied thereto external air that is stored in the pressure vessel and is under positive pressure.

By using such sweeping machines, a ground surface can be swept, with coarse debris being transferred into the debris container by the sweeping brush, which is capable of being driven in rotation. Performing the sweeping operation on a dry ground surface often causes considerable amounts of dust to be generated. To counteract this, the sweeping machine has a suction fan which is in flow communication with the sweeping brush so that dust-laden air can be suctioned, whereby the generation of dust can be reduced. On its way from the sweeping brush to the suction fan, the drawn air passes through at least one filter where dust and dirt particles entrained in the air can be separated.

During operation of the sweeping machine, dust and dirt particles are increasingly deposited on the at least one filter's dirty side, which faces towards the sweeping brush, and as a result of this the filter offers increasing resistance to flow. Therefore, it is necessary to clean the filter from time to time. For this purpose, WO 2009/132757 A1 proposes a manual filter cleaning device comprising a slider which can be displaced by the user along the dirty side of the filter. With the aid of said slider, dust and dirt particles adhering to the dirty side of the filter can be wiped off.

Document DE 34 06 816 A1 discloses a sweeping machine in which the filter is configured in the form of a cylindrical filter cartridge. An external air supply tube extends into the filter cartridge on a clean side thereof so that via the external air supply tube, which has a multiplicity of nozzle-like openings, external air under pressure can be supplied to the clean side of the filter. The external air supply tube is in flow communication with a connection piece by way of a hose conduit, and said connection piece is capable of being connected to a source of compressed air. This provides the possibility of applying external air under pressure to the clean side of the filter by way of the compressed air supply tube. The external air can pass through the filter cartridge in the reverse direction with respect to the direction of flow during normal sweeping operation, whereby dust and dirt particles adhered to the dirty side of the filter cartridge can be dislodged.

Also, sweeping machines are known in which, in lieu of an external air supply tube which extends axially into a filter cartridge and has a multiplicity of lateral openings, an external air supply nozzle is used which is arranged in alignment with the longitudinal axis of the filter cartridge, at a distance to the clean side thereof. By way of the external air supply nozzle, external air under positive pressure can flow into the cylindrical filter cartridge from the clean side thereof. Provision may be made for the sweeping machine to have a multiplicity of filter cartridges which are arranged parallel to one another and each of which has an external air supply nozzle associated with it. The external air supply nozzles are in flow communication with a pressure vessel by way of an external air conduit, said pressure vessel holding a store of external air under positive pressure. Such a sweeping machine is described for example in document DE 26 29 967 A1 A similar sweeping machine is disclosed in U.S. Pat. No. 4,756,727 A.

In order for the external air flowing from the external air supply nozzle to the filter cartridge to cover as large an area as possible on the clean side thereof, U.S. Pat. No. 4,452,616 proposes the use of a diffuser arranged between the external air supply nozzle and the filter cartridge. A similar configuration is described in U.S. Pat. No. 3,798,878.

In order to achieve as effective a filter cleaning action as possible, U.S. Pat. No. 4,486,201 proposes, in addition to the use of an external air supply nozzle that is arranged in alignment with the longitudinal axis of a filter cartridge and applies external air under positive pressure to the clean side of the filter cartridge, the use of further external air supply nozzles that direct external air at the dirty side of the filter cartridge, wherein the external air is routed axially along the dirty side of the filter cartridge in order to enhance the release of dust and dirt particles from the dirty side of the filter.

A disadvantage associated with the known sweeping machines is that an effective filter cleaning operation is only ensured when a considerable amount of external air is passed through the filter. This large amount of external air must subsequently be extracted again by the suction fan within a short interval of time, because otherwise there is a risk of the external air escaping from the sweeping machine in the area of the sweeping brush, thereby increasing the generation of dust when sweeping is being performed on a dry ground surface. A further disadvantage is that the external air has to be supplied under considerable positive pressure to the filters. Thus, for example, DE 26 29 967 A1 proposes a pressure greater than 7 bar for the external air. Such a level of positive pressure requires additional safety precautions to be taken in order to prevent hazard to the user of the sweeping machine.

It is therefore an object of the present invention to improve a sweeping machine of the kind mentioned at the outset such that the at least one filter can be cleaned effectively with as small an amount of external air as possible and with said external air being at as low a positive pressure as possible.

SUMMARY OF THE INVENTION

In accordance with the invention, this object is achieved in a sweeping machine of the generic kind by the external air conduit comprising a hood which covers a filter on a clean side thereof and forms a first section of the suction conduit which adjoins the clean side of the filter.

Effective filter cleaning can be accomplished with a relatively small amount of external air under only a low positive pressure provided that it is ensured that the external air impinges on the filter's clean side over a large area thereof. To ensure this, the filter to be cleaned is covered by a hood via which the external air is supplied to the filter. On its flow path from the pressure vessel to the filter to be cleaned, the external air flows through the hood without incurring considerable pressure loss within the hood. Effective filter cleaning can therefore be accomplished even if the external air is under only a low positive pressure.

The hood not only serves to provide flow communication between the pressure vessel and the filter being cleaned, it also forms a first section of the suction conduit, adjoining the filter on the clean side thereof. This is advantageous in that it eliminates the need for a separate flow path to be provided for the suction conduit so that the hood can extend directly to the clean side of the filter to be cleaned, thereby allowing the external air to impinge against the filter's clean side directly without the external air having to pass through a space, required for the suction conduit, between the hood and the clean side of the filter. Thus, by using the hood, the external air is conducted to the clean side of the filter directly.

The at least one filter is preferably configured as a flat pleated filter. It may be configured in the form of a filter cassette. The shape of the filter-side end region of the hood may be adapted to the shape of the perimeter of the flat pleated filter. For example, provision may be made for the filter-side end region of the hood as well as the flat pleated filter to be rectangular in shape.

In an advantageous embodiment, the hood has an external air inlet which is associated with an external air valve, and has an external air outlet which is associated with the filter, wherein the opening cross-section of the external air outlet is at least half the size of the clean side of the filter. In particular, provision may be made for the opening cross-section of the external air outlet to be the same size as the clean side of the filter. This provides a particularly simple design for applying external air to the whole of the clean side of the filter.

Advantageously, the external air outlet lays against a clean-side edge of the filter. The hood thus extends to the clean-side edge of the filter directly. This is advantageous in that the hood not only serves the function of supplying external air directly to the clean side of the filter being cleaned but it also assumes the function of a stop element for the filter. Fixing the filter in the sweeping machine can thus be effected by way of the hood, which covers the filter on its clean side.

It is advantageous for the hood to have a curved hood section between an external air inlet associated with the external air valve and an external air outlet associated with the filter. This affords the possibility of providing for the external air inlet an orientation in space which is different from that of the external air outlet, and yet the external air can be routed from the external air inlet to the external air outlet with very low losses in flow. For example, the external air inlet can be arranged in a plane that is inclined relative to a plane defined by the external air outlet. The orientation of the external air inlet can thus be independent of the orientation of the hood's external air outlet. This gives the possibility of a particularly compact design of the sweeping machine.

The hood may have a region of reduced flow cross-section in the area between the external air inlet and the external air outlet. In this regard, it is advantageous for the cross-sectional flow area at the narrowest location of the hood to be at least 20% of the cross-sectional flow area of the external air outlet. It is particularly advantageous for the minimum cross-sectional flow area of the hood to be at least 50% of the cross-sectional flow area of the external air outlet. The hood may for example be configured in the form of a double cone by having an external air inlet region which is followed, in the direction towards the filter to be cleaned, by a region of reduced flow cross-section which is itself followed in the direction towards the filter to be cleaned by a filter outlet region of increased flow cross-section.

In a particularly preferred embodiment of the invention, the for example arcuately shaped hood section between the external air inlet and the external air outlet is curved through 90°. This affords the possibility of arranging a valve seat of the external air valve in a vertically oriented plane, whereas the clean side of the filter, advantageously configured as a flat pleated filter, is oriented horizontally.

In a preferred configuration of the invention, a particularly space-saving arrangement of the external air valve is achieved by the hood having an external air inlet section into which an external air valve extends at least partially. With such a configuration, the external air valve is at least partially arranged in the external air inlet section of the hood. The external air inlet section thus at least partially surrounds the external air valve. This not only results in a space-saving arrangement of the external air valve but also allows the external air flowing out of the pressure accumulator via the external air valve to be supplied to the hood directly, with the external air experiencing only a small loss in pressure.

For example, provision may be made for the external air inlet section to receive a movable valve body of the external air valve. The valve body is movable back and forth between a closed position and an open position of the external air valve. It may for example be configured in the form of a pivotable valve flap or in the form of a linearly movable valve disc.

By way of example, the external air valve may be configured as a magnetic valve. Advantageously, it comprises a valve disc which, in a closed position, contacts a valve seat and, in an open position, assumes a distance from the valve seat. The valve disc can be held in its closed position by way of a closing spring and/or under the action of the holding force of an electromagnet. To open the external air valve, the valve disc can be moved in the direction facing away from the valve seat so that it opens flow communication between the pressure vessel and the hood. For example, provision may be made for the valve disc to be held in a closed position by an electromagnet having an electric current applied thereto. The electromagnet can be connected to an electric control unit of the sweeping machine, and the excitation current to the electromagnet can be interrupted by the control unit at intervals of time. Owing to the positive pressure acting on it, the valve disc can then automatically move to its open position. A pressure pulse can thereby be generated that is transmitted to the clean side of the filter via the hood so that the filter is mechanically shaken, and at least a portion of the external air impinging against the clean side can pass the filter in a direction counter to the direction of flow therethrough during normal sweeping operation. After momentarily interrupting the excitation current, the electric control unit can reestablish the flow of excitation current so that the valve disc is again held in its closed position.

Advantageously, the hood comprises an external air outlet section which forms the first section of the suction duct and which is followed in a direction towards the suction fan by at least a second section of the suction duct.

Advantageously, the hood is of multi-piece configuration.

Alternatively, provision may be made for the hood to be configured as a one-piece moulded plastic part.

Provision may be made for the sweeping machine to have only a single filter that is in flow communication with the pressure vessel directly via the hood.

It is particularly advantageous for the sweeping machine to have a plurality of filters which are in flow communication with the pressure vessel via an external air conduit and are covered on the clean side thereof by a hood of the external air conduit. This affords the possibility of arranging between the sweeping brush and the suction fan and parallel to one another in a direction of flow a plurality of filters via which the drawn air can be cleared from particles of dust and dirt. The total available filter surface area can thereby be increased. To achieve effective cleaning of all filters, each of these is covered by a hood via which the filters are in flow communication with an external air valve and also with the suction fan.

Advantageously, the at least one external air valve is arranged on a wall of the pressure vessel directly. Pressure losses incurred by the external air on its way from the pressure vessel to the external air valve can thereby be avoided. In addition, this allows for a particularly compact configuration of the sweeping machine.

Preferably, the pressure vessel has, in each of opposed side walls thereof, an external air opening capable of being closed by an external air valve, with each external air valve being adjoined by an external air conduit comprising a hood which covers the filter associated with the external air valve on its clean side. Hence, the pressure vessel is arranged between two external air valves, each of which has a filter associated with it. Preferably, the external air valves each comprise a valve seat which is arranged in a vertical plane.

The positive pressure of the external air existing in the pressure vessel is advantageously 1 bar maximum. The positive pressure level is therefore relatively low. Owing to the provision of the hood, which covers the filter to be cleaned on the clean side thereof and via which the external air is supplied to the filter, effective filter cleaning can be accomplished despite the relatively low positive pressure of the external air.

Moreover, providing for a positive pressure of 1 bar maximum has the advantage that the valve opening of the at least one external air valve can be configured to be of relatively large area. The large valve opening in turn ensures that a strong pressure pulse can be generated upon momentarily opening the external air valve. This pressure pulse enhances the filter cleaning action.

Preferably, the positive pressure in the pressure vessel amounts to 500 mbar maximum. In particular, provision may be made for the positive pressure in the pressure vessel to be 250 mbar to 400 mbar, for example 350 mbar.

In an advantageous embodiment of the invention, the at least one external air valve is configured as a safety valve which opens automatically when the positive pressure inside the pressure vessel reaches a maximum admissible value. An additional safety valve can thereby be dispensed with. In such an embodiment, the at least one external air valve serves two functions. On the one hand, it allows short-time provision of a pressure pulse for cleaning a filter. On the other hand, it limits the maximum admissible pressure in the pressure vessel. If the pressure inside the pressure vessel exceeds a maximum admissible value, then the at least one external air valve automatically moves to its open position so that external air under positive pressure can escape from the pressure vessel.

Providing a plurality of external air valves has the advantage that a first filter can be cleaned, while at the same time a sweeping suction operation can be maintained via at least a second filter. External air flowing through the first filter during the filter cleaning operation can be suctioned by the suction fan via the second filter so that there is no risk of the external air exiting to the atmosphere via the sweeping brush.

It is particularly advantageous if following the first momentary opening of an external air valve and performance of the associated cleaning operation on a filter, all the external air valves are at first closed so that a normal sweeping suction operation is established, and if then a different external air valve is momentarily opened to be thereafter returned to its closed position for another sweeping suction operation following the filter cleaning operation. Thus, each filter cleaning operation is followed by a normal sweeping suction operation. This ensures that all external air is reliably extracted by the suction fan.

It is advantageous for the at least one filter to be capable of being replaced. In this regard, it is advantageous for the filter to be capable of being replaced from the clean side. With such a configuration, the filter can be removed by the user from the clean side of a filter holder. The risk of the user coming into contact with dust and dirt adhered to the filter is thereby reduced.

In an advantageous embodiment of the sweeping machine in accordance with the invention, the pressure vessel and the at least one external air valve are arranged on a pivotally mounted cover part of a housing of the sweeping machine. The cover part can be pivoted back and forth between a closed position in which it rests on a bottom part of the housing and ensures flow communication between the at least one filter and the suction fan and an open position in which it exposes the at least one filter on the clean side thereof. This facilitates replacement of the at least one filter and also affords easy access to the hood, which covers a filter in each case.

It is particularly advantageous for the hood also to be held on the cover part of the housing of the sweeping machines. In the open position of the cover part, the hood is thus also accessible to the user, for example for inspection purposes.

The following description of a preferred embodiment of the invention, taken in conjunction with the drawings, serves to explain the invention in greater detail.

DETAILED DESCRIPTION OF THE INVENTION

Figure 1:
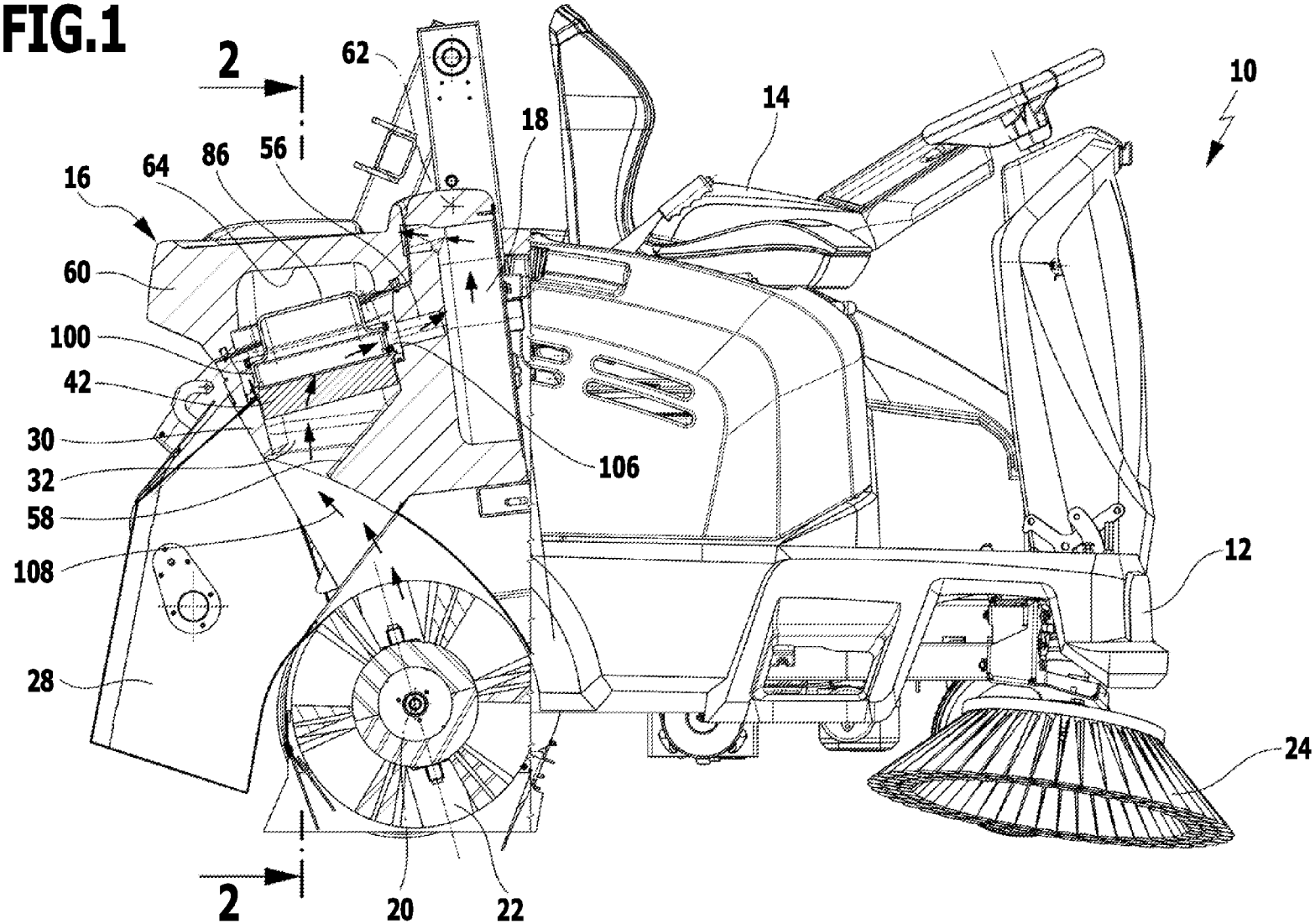
FIG. 1 is a partially cut away side view of a sweeping machine constructed in accordance with the invention.

The drawing is a schematic representation of a sweeping machine 10, constructed in accordance in with the invention, comprising a chassis 12 and a driver's seat 14 and comprising a housing 16 in which a suction fan 18 is arranged in an area behind the driver's seat 14 and which has mounted on its underside a sweeping brush which is in the form of a sweeping roller 22 and can be driven in rotation about a horizontal axis of rotation 20. The sweeping roller 22 is driven with the aid of a motor which is known per se and therefore not shown in the drawing in the interest of clarity. Said motor may be, for example, a combustion engine or an electric motor. At the same time, the drive motor of the sweeping roller 22 can form the propelling drive of the mobile sweeping machine 10.

In addition to the sweeping roller 22, the sweeping machine 10 comprises a disc brush 24 which is arranged in a front region of the sweeping machine 10 beneath the chassis 12 and can likewise be driven for rotational movement. The rotational axis of the disc brush 24 is substantially vertically oriented.

The sweeping machine 10 comprises a debris container 28 that is detachably held on a housing lower part 30 and receives coarse debris which is picked up from a ground surface with the aid of the sweeping roller 22.

Figure 3:
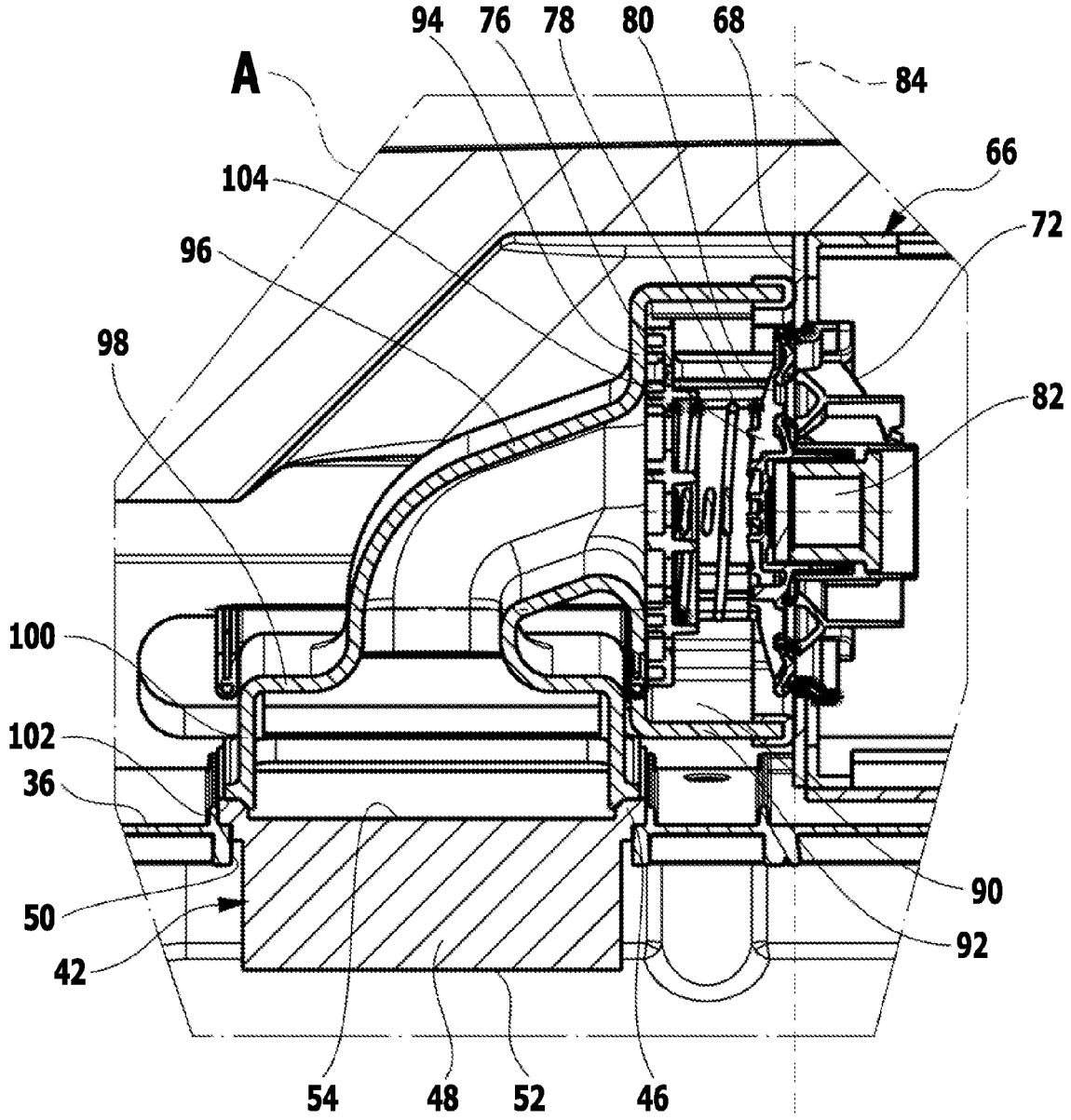
FIG. 3 is an enlarged view of Detail A of FIG. 2.

Extending within the housing lower part 30 is a suction channel 32 which starts from the sweeping roller 22 and extends to a suction channel opening 34 of the housing lower part 30. Arranged at the suction channel opening 34 is a holding plate 36 having a first suction opening 38 and a second suction opening 40. Arranged at the first suction opening 38 is a first filter 42, and arranged at the second suction opening 40 is a second filter 44. The two filters 42 and 44 are of identical configuration, each in the form of a flat pleated filter and each forming a filter cassette having a circumferentially extending filter edge 46 which projects externally above a filter material 48 and rests on an edge opening 50 of the first suction opening 38 and of the second suction opening 40 respectively. This can be seen from FIG. 3 in particular.

The two filters 42 and 44 each have a dirty side 52, facing towards the sweeping roller 22, and a clean side 54, facing away from the sweeping roller 22.

In a longitudinal direction of the sweeping machine 10, between the filters 42, 44 and the suction fan 18, the housing lower part 30 has a passage 56 which extends to the suction fan 18.

Below the filters 42 and 44, the housing lower part 30 forms an impact wall 58 which is oriented obliquely to the vertical.

On the upper side, the housing lower part of the sweeping machine 10 has a cover part 60 articulately connected thereto, said cover part 60 being pivotable back and forth about a pivot axis 62 oriented parallel to the rotational axis 20 of the sweeping roller 22, between a closed position illustrated in FIG. 1 and an open position not shown in the drawing. The cover part 60 has a receptacle 64 which is open in a direction towards the housing lower part 30 and has a pressure vessel 66 arranged therein. The pressure vessel 66 has a first side wall 68 and a second side wall 70 opposite thereto. The two side walls 68, 70 are of identical configuration. Arranged at the first side wall 68 is a first external air valve 72, and arranged at the second side wall 70 is a second external air valve 74. The two external air valves 72, 74 are of identical configuration. They each have a movable valve body in the form of a valve disc 76 which is urged in a direction towards a closed position by a helical closing spring 78, in which closed position it sealingly closes an external air opening 80 integrally formed in the respective side walls 68 and 70. In the closed position of the valve disc 76, the closing spring is in its relaxed state. The closing spring 78 is placed in tension as the valve disc 76 is shifted from its closed position to its open position. The valve disc 76 is held in its closed position by way of an electromagnet 82. To this end, the electromagnet 82 has an excitation current applied thereto by a control device of the sweeping machine 10 which is known per se and therefore not shown in the drawing for clarity of illustration. When the excitation current is interrupted, the valve disc 76 automatically moves to an open position in which it assumes a distance from the external air opening 80, due to the positive pressure exerted on the valve disc 76 by the external air stored in the pressure vessel 66, whereby external air is allowed to flow out of the pressure vessel 66. Subsequently, the closing spring 78 returns the valve disc 76 to its closed position in which it is held under the action of the electromagnet 82, which has again its excitation current applied to it.

The external air openings 80 of the two side walls 68, 70 are arranged in a vertically oriented plane 84. This is shown in broken lines in FIG. 3.

The external air opening 80 that is integrally formed in the first side wall 68 of the pressure vessel 66 is in flow communication with the first filter 42 by way of a first external air conduit, which is configured in the form of a first hood 86. In a corresponding manner, the external air opening 80 integrally formed in the second side wall 70 of the pressure vessel 66 is in flow communication with the second filter 44 by way of a second external air conduit in the form of a second hood 88. The two hoods 86 and 88 are of identical configuration. They each comprise an external air inlet section 90 which adjoins the respective side walls 68 and 70 and has an outer wall 92. The external air inlet section 90 merges, via an inwardly directed step 94, into an arcuately curved hood section 96 that undergoes an expansion via a second step 98 and merges into an external air outlet section 100 which is rectangular in cross-section. The cross-sectional area of the external air outlet section 100 is of the same size as the cross-sectional area of the clean side 54 of the filters 42 and 44 respectively, which is covered by the external air outlet section 100 of the first hood 86 and of the second hood 88 respectively. The external air outlet section 100 has on its outer side a circumferentially extending hood edge 102 which rests on the filter edge 46 of the first filter 42 and of the second filter 44 respectively if the cover part 60 assumes its closed position. Thus, in the closed position of the cover part 60, the first filter 42 is urged against the opening edge 50 of the first suction opening 38 by the first hood 86 and the second filter 44 is urged against the opening edge 50 of the second suction opening 40 by the second hood 88. When the cover part 60 is pivoted upwards about its pivot axis 62 so that it assumes a distance to the housing lower part 30, then the two hoods 86 and 88 expose the filters 42 and 44, which can then be removed by the user from the clean side of the suction openings 38, 40 if required, for example in order to replace the filters 42, 44. New filters can then be placed into the suction openings 38 and 40 respectively from the clean side thereof, and by closing the cover part 60, these are urged against the respective opening edge 50 of the suction openings 38 and 40 by the hoods 86 and 88.

The external air inlet section 90 of the two hoods 86, 88 in each case forms, by way of its first step 94, a supporting element at which is arranged a grid-shaped spring holder 104 on which rests the closing spring 78, which is arranged between the spring holder 104 and the valve disc 76. The valve disc 76 as well as the closing spring 78 and the spring holder 104 are arranged in the external air inlet section 90.

Starting from the external air inlet section 90, the flow cross-section of the hoods 86, 88 is reduced via the first step 94 to form, in the area of the curved hood section 96, a region of minimum flow cross-section which then increases again via the second step 98. The minimum cross-sectional flow area of the curved hood section 96 is at least 20%, preferably at least 50% of the cross-sectional flow area of the external air outlet section 100 and hence also of the area of the clean side 54 of the filters 42 and 44 respectively.

The external air outlet sections 100 each have a hood opening 106 on the side thereof facing towards the suction fan 18. This can be seen from FIG. 1 in particular. The hood openings 106 are in flow communication with the suction fan 18 via the passage 56 of the housing lower part 30. With the cover part 60 closed, flow communication can thereby be established, wherein air laden with dust and dirt particles is suctioned by the suction fan 18 via the passage 56, the external air outlet sections 100 of the two hoods 86, 88, the filters 42 and 44 respectively and the suction channel 32. The course of the suction flow is indicated by arrows 108 in FIG. 1. The external air outlet sections 100 thus form a first section of a suction conduit which extends from the clean side 54 of the filters 42 and 44 respectively to the suction fan 18. A second section of the suction conduit is formed by the passage 56 of the housing lower part 30.

During normal sweeping operation, the sweeping roller 22 is driven for rotary movement about the rotational axis 20, while at the same time dust-laden air is suctioned by the suction fan 18 via the suction channel 32, the filters 42, 44, the external air outlet sections 100 of the two hoods 86, 88 and the passage 56 of the housing lower part 30. Coarse debris is transferred by the sweeping roller 22 into the debris container 28, and the suctioned air is cleared of dust by the filters 42, 44. A large portion of the dust deposits on the dirty side 52 of the filters 42, 44. This increases the resistance to flow of the filters 42, 44, and the suction effect of the suction fan 18 is increasingly reduced within the suction channel 32.

Figure 2:
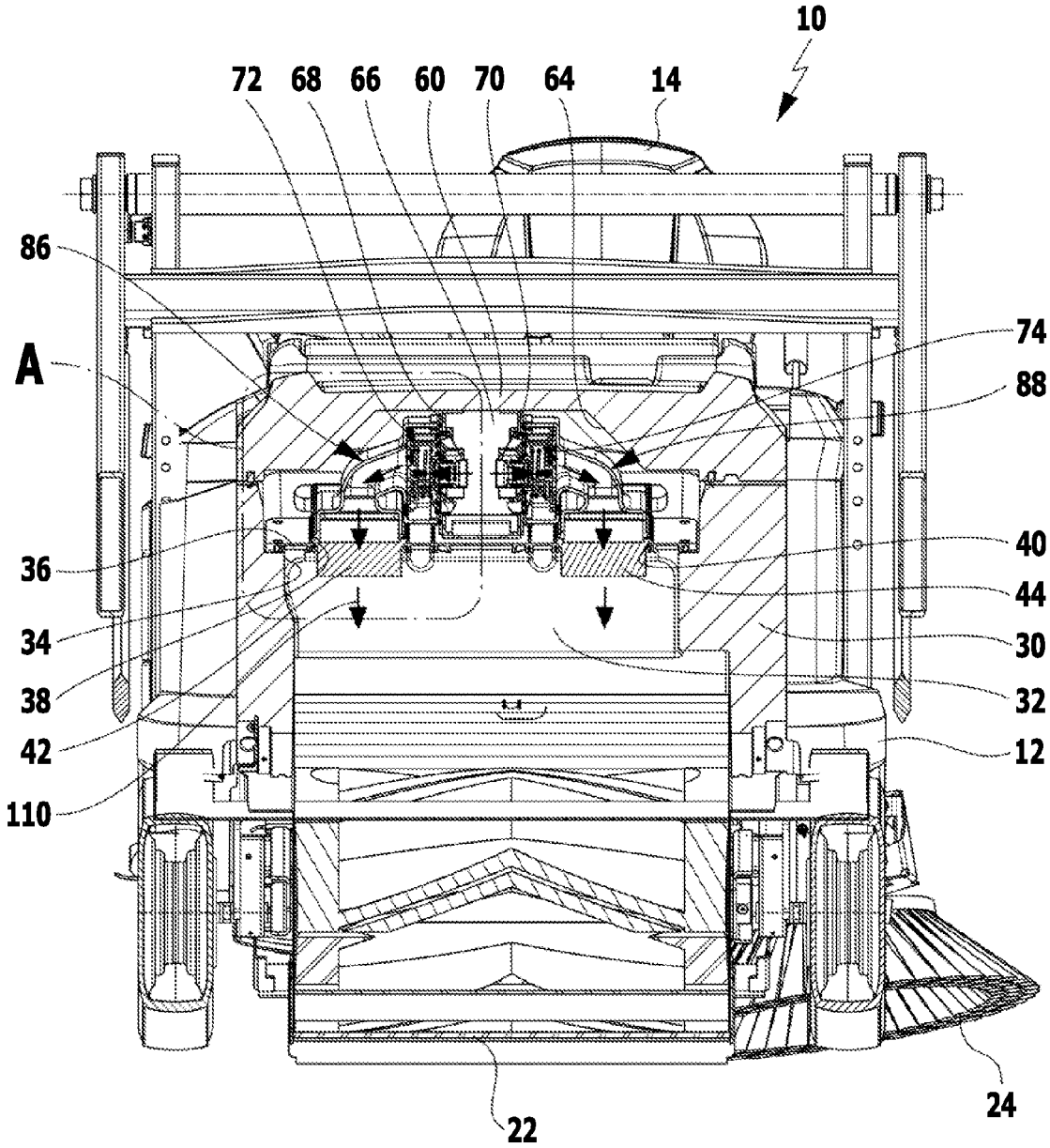
FIG. 2 is a sectional view taken along the line 2-2 in FIG. 1.

Therefore, the filters 42, 44 have a cleaning operation performed on them at certain, preferably regular, time intervals. In this process, one of the filters 42, 44 is cleaned at a time, while at the same time maintaining suction operation via the other of the filters 42, 44. For filter cleaning, the respective external air valve 72 or 74 associated with the filter to be cleaned is momentarily opened by interrupting the excitation current to the electromagnet 82. External air under positive pressure that is stored in the pressure vessel 66 can thereby be supplied via the respective first hood 86 or second hood 88 to the clean side 54 of the filter being cleaned. The external air is applied to the clean side 54 in a sudden burst, and due to the very low pressure losses the external air incurs in the region of the respective first hood 86 or second hood 88, a strong pressure pulse is created that mechanically shakes the respective filter 42 or 44 being cleaned. A portion of the external air is passed through the filter 42, 44 being cleaned in a direction counter to the flow direction 108 during normal suction operation and is removed again by suction via the respective adjacent filter 42 or 44, since operation of the suction fan 18 is not interrupted during the filter cleaning procedure. The external air flow created during a filter cleaning operation is schematically illustrated by the arrows 110 in FIG. 2, using the cleaning operation on the first filter 42 as an example.

In the exemplary embodiment illustrated, the hood sections 96 of the two hoods 86, 88 are each curved through 90°. This provides for a particularly compact configuration of the cover part 60 of the sweeping machine 10. The pressure vessel 66 is arranged between the two external air valves 72, 74 and is connected to the filters 42, 44 via hoods 86, 88 of identical configuration. The positive pressure within the pressure vessel 66 during sweeping operation is less than 1 bar, in particular less than 0.5 bar. To provide the external air under pressure, the sweeping machine 10 may comprise a compressor, known per se and not shown in the drawing, which is in flow communication with the pressure vessel 66 via a pressure conduit known per se and therefore not shown in the drawing in the interest of clarity. The compressor can be put into operation at intervals of time in order to provide within the pressure vessel 66 a positive pressure of for example 280 mbar to approximately 450 mbar, particularly a positive pressure of 330 mbar. Alternatively, provision may be made for the compressed air vessel to be connected to an external source of compressed air via a compressed air connector in order to provide the desired positive pressure inside the pressure vessel 66.

As has already been mentioned, the filters 42, 44 are preferably cleaned one after the other, with a normal sweeping suction operation in which the two external air valves 72, 74 are closed being established between two filter cleaning operations in each case. Alternatively, provision may be made for the two filters 42, 44 to be cleaned simultaneously at certain intervals of time by momentarily opening the two external air valves 72, 74 simultaneously.

The external air valves 72, 74 have not only the function of applying a pressure pulse to the filters 42, 44 associated therewith in each case, but also that of serving as safety valves with which it is ensured that no inadmissibly high positive pressure develops within the pressure vessel 66. Should the positive pressure within the pressure vessel 66 exceed a predetermined maximum value, as for example in the event of a malfunction occurring in the above described compressor, then the external air valves 72, 74 move automatically to their open position. To this end, the magnetic holding force exerted on the valve discs 76 by the electromagnets 82 is predetermined such that when the maximum admissible positive pressure within the pressure vessel is exceeded, the pressure force acting on the valve discs 76 due to the existing positive pressure will exceed the magnetic holding force. The external air valves 72, 74 thus also assume the function of a safety valve for the pressure vessel 66 so that the need for an extra safety valve can be eliminated.

Overall, the sweeping machine 10 provides a construction that is simple and cost-effective to assemble. Effective filter cleaning is achieved despite the provision of a relatively low positive pressure of less than 500 mbar in the pressure vessel 66. This allows the use of relatively small filters 42, 44 and of a suction fan 18 with relatively low electric power. Despite the use of the rather small filters 42, 44, the suction fan 18 maintains a permanent negative pressure in the area of the suction channel 32 so that the generation of dust during operation of the sweeping machine is kept low even while the filters 42, 44 are being cleaned. It is ensured that no external air leaks to the outside by way of the suction channel 32 and the sweeping roller 22 when the filters 42, 44 are being cleaned.

That which is claimed:

1. A sweeping machine comprising a sweeping brush that is capable of being driven in rotation, a debris container and a suction fan for suctioning dust-laden air, and at least one filter arranged in the flow path between the sweeping brush and the suction fan, for separating particles of dust and dirt from the suctioned air, wherein the filter is in flow communication with the suction fan by way of a suction conduit and is in flow communication with a pressure vessel by way of an external air conduit and at least one external air valve and, for filter cleaning, is capable of having applied thereto external air that is stored in the pressure vessel and is under positive pressure, wherein the external air conduit comprises a hood which covers a filter on a clean side thereof and forms a first section of the suction conduit which adjoins the clean side of the filter.

2. The sweeping machine in accordance with claim 1, wherein the at least one filter is configured as a flat pleated filter.

3. The sweeping machine in accordance with claim 1, wherein the hood has an external air inlet which is associated with an external air valve, and has an external air outlet which is associated with the filter, wherein the opening cross-section of the external air outlet is at least half the size of the clean side of the filter.

4. The sweeping machine in accordance with claim 3, wherein the external air outlet lays against a clean-side edge of the filter.

5. The sweeping machine in accordance with claim 1, wherein the hood has an arcuately curved hood section between an external air inlet associated with the external air valve and an external air outlet associated with the filter.

6. The sweeping machine in accordance with claim 5, wherein the arcuately curved hood section is curved through 90°.

7. The sweeping machine in accordance with claim 1, wherein the hood has an external air inlet section into which an external air valve extends at least partially.

8. The sweeping machine in accordance with claim 7, wherein the external air inlet section receives a movable valve body of the external air valve.

9. The sweeping machine in accordance with claim 1, wherein the hood comprises an external air outlet section which forms the first section of the suction conduit and which is connected to the suction fan via a second section of the suction conduit.

10. The sweeping machine in accordance with claim 1, wherein the hood is of multi-piece configuration.

11. The sweeping machine in accordance with claim 1, wherein the sweeping machine has a plurality of filters which are in flow communication with the pressure vessel via an external air conduit and are covered on the clean side thereof by a hood of the external air conduit.

12. The sweeping machine in accordance with claim 11, wherein the pressure vessel has, in each of opposed side walls thereof, an external air opening that is closable by an external air valve, with each external air valve being adjoined by an external air conduit comprising a hood which covers a filter associated with the respective external air valve on its clean side.

13. The sweeping machine in accordance with claim 1, wherein the positive pressure in the pressure vessel is 1 bar maximum.

14. The sweeping machine in accordance with claim 1, wherein the at least one external air valve is a safety valve which opens automatically when a maximum admissible positive pressure inside the pressure vessel is exceeded.

15. The sweeping machine in accordance with claim 1, wherein the at least one filter is replaceable from the clean side.

16. The sweeping machine in accordance with claim 1, wherein the pressure vessel and the at least one external air valve are arranged in a pivotally mounted cover part of a housing of the sweeping machine.

* * * * *

UNITED STATES PATENT AND TRADEMARK OFFICE

CERTIFICATE OF CORRECTION

PATENT NO. : 9,220,387 B2
APPLICATION NO. : 14/154914
DATED : December 29, 2015
INVENTOR(S) : Nonnenmann et al.

It is certified that error appears in the above-identified patent and that said Letters Patent is hereby corrected as shown below:

Title Page

Item (72) Inventors: the name of the city of residence for the first inventor is spelled incorrectly, it should appear as follows:

Frank Nonnenmann, Schorndorf (DE)

Signed and Sealed this
Nineteenth Day of July, 2016

Michelle K. Lee

Michelle K. Lee
*Director of the United States Patent and Trademark Office*